US007727091B2

(12) United States Patent
Allen

(10) Patent No.: US 7,727,091 B2
(45) Date of Patent: Jun. 1, 2010

(54) TABLE TENNIS GAME APPARATUS AND METHOD OF PLAY THEREOF

(76) Inventor: Richard G. Allen, 11602 N. 41st Dr., Phoenix, AZ (US) 85029-3016

( * ) Notice: Subject to any disclaimer, the term of this patent is extended or adjusted under 35 U.S.C. 154(b) by 931 days.

(21) Appl. No.: 11/426,070

(22) Filed: Jun. 23, 2006

(65) Prior Publication Data

US 2007/0298914 A1 Dec. 27, 2007

(51) Int. Cl.
*A63B 67/04* (2006.01)

(52) U.S. Cl. ..... 473/496

(58) Field of Classification Search ..... 108/59, 108/64, 65, 78, 90; 473/496
See application file for complete search history.

(56) References Cited

U.S. PATENT DOCUMENTS

| | | | | |
|---|---|---|---|---|
| 2,654,647 | A * | 10/1953 | Murray | 108/173 |
| 3,172,664 | A | 3/1965 | Lohr et al. | 273/340 |
| 3,452,985 | A | 7/1969 | D'Zmura | 273/30 |
| D221,672 | S | 8/1971 | Kalilich | D21/799.2 |
| 3,622,156 | A | 11/1971 | Pugsley | 473/496 |
| 3,655,187 | A | 4/1972 | Pugsley | 473/496 |
| 4,089,522 | A * | 5/1978 | Rock | 108/173 |
| 4,336,942 | A | 6/1982 | Warehime | 273/411 |
| 4,772,018 | A | 9/1988 | Inniger | 473/475 |
| 5,027,718 | A * | 7/1991 | Graham, Sr. | 108/64 |
| 6,007,438 | A | 12/1999 | Harrell | 473/496 |
| 6,120,397 | A * | 9/2000 | Julian | 473/496 |
| 6,155,939 | A | 12/2000 | Takacs | 473/496 |
| 6,321,664 | B1 | 11/2001 | Damour et al. | 108/168 |
| 6,382,109 | B1 * | 5/2002 | Novikoff | 108/65 |
| 6,425,835 | B1 | 7/2002 | Kettler | 473/496 |
| 6,645,096 | B1 | 11/2003 | Nally et al. | 473/496 |
| 6,729,982 | B1 | 5/2004 | Appelbaum et al. | 473/496 |
| 6,916,258 | B2 | 7/2005 | Dadbeh | 473/496 |
| 6,990,910 | B2 | 1/2006 | Kettler et al. | 108/115 |

(Continued)

FOREIGN PATENT DOCUMENTS

DE 3622823 A1 * 1/1988

(Continued)

OTHER PUBLICATIONS

G. Arndt, "Table Tennis Triples: A New Team Sport", (http://www.trafford.com/07-0540), Trafford Publishing, Jul. 2007.

(Continued)

*Primary Examiner*—Raleigh W. Chiu
(74) *Attorney, Agent, or Firm*—Zaretsky Patent Group PC; Howard Zaretsky

(57) ABSTRACT

A novel and versatile table tennis game and method of play thereof is disclosed. The table tennis table game is played on a playing surface in the shape of a hexagon having three pairs of equal length opposing edges. A net is placed in the center of the table to divide the playing surface into two or three separate playing areas. Two playing areas accommodates a maximum of three individuals on both sides of the net. Three playing areas accommodates either three individuals playing against each other or three teams of two individuals playing against each other. A folding support mechanism provides both support and storage for either a 2-piece or a 6-piece table top.

13 Claims, 10 Drawing Sheets

U.S. PATENT DOCUMENTS

| | | | | |
|---|---|---|---|---|
| 7,214,149 | B1 * | 5/2007 | Nowitzky et al. | 473/496 |
| 7,367,907 | B1 * | 5/2008 | Sutton et al. | 473/496 |
| 2004/0005941 | A1 | 1/2004 | Chen | 473/496 |
| 2005/0268826 | A1 * | 12/2005 | Ferreira | 108/78 |
| 2006/0118011 | A1 * | 6/2006 | Caeton | 108/90 |
| 2007/0105665 | A1 * | 5/2007 | Nowitzky et al. | 473/496 |
| 2007/0191132 | A1 | 8/2007 | Bangerter | 473/296 |
| 2007/0298914 | A1 * | 12/2007 | Allen | 473/496 |

FOREIGN PATENT DOCUMENTS

| | | |
|---|---|---|
| DE | 3800430 | 7/1989 |
| FR | 2794658 | 12/2000 |
| JP | 410295865 | 11/1998 |

OTHER PUBLICATIONS http://www.freshtrend.com/2007/01/ping-pong-for-three.html, Ping Pong For Three?, Jan. 2007.
http://www.polypong.com/, Poly Pong.

* cited by examiner

TABLE TENNIS GAME APPARATUS AND METHOD OF PLAY THEREOF

FIELD OF THE INVENTION

The present invention relates to the field of table tennis game tables and more particularly relates to an apparatus for a hexagonal shaped table tennis game and the method of play thereof.

BACKGROUND OF THE INVENTION

The traditional table tennis game, developed during the 1800s in England, has for years been a table game played by young and old both for recreational pleasure and for competitive sport. In the traditional table tennis game, however, a rectangular playing surface permits either two people to play against each other (one on each side) or two teams of two (two on each side) can play against each other. Thus, with two teams of two people each, a maximum of four players can realistically play at any one time. In terms of scoring, the traditional table tennis game provides for a maximum number of points per rally of one single point.

Often times, however, it is desirable if more than two or four people can play a game of table tennis at one time. The ability to accommodate a third player on a team would permit more people to enjoy the game together either for recreation or competition. Further, it would be desirable if the rules of game play permitted scoring other than a single point on each serve.

SUMMARY OF THE INVENTION

The invention provides a novel and versatile table tennis game and method of play thereof. The table tennis table of the present invention is played on a playing surface that has the shape of a hexagon with three pairs of equal length opposing edges. A net placed in the center of the playing surface functions to divide the playing surface into two or three separate areas. With a net that spans the width of the table from one corner of the hexagon table top to an opposing corner, the playing surface is divided into two playing areas. Two playing areas permits a maximum of three individuals on both sides of the nets can play at the same time. With a three-way net that spans three opposing corners of the hexagon table top, the playing surface is divided into three playing areas. Three playing areas permits either three individuals to play against each other or three teams of two individuals to play against each other.

Using a conventional table tennis ball and table tennis paddles, individual players test their skills and strategy to win points. In one embodiment of the invention, the object of the game is for an individual or team of players to be the first to win 25 points or to win by two points any time after a tie of 25 points. Players utilize their skills to maximize the points that can be won during a rally and strategize on the most advantageous way to win the rally. Beads attached to the net aid in the keeping of score since there is a potential for to score a maximum of 4 points at every rally.

The present invention relates to a table tennis table game that goes beyond traditional table tennis in regard to its shape, unique line layout, scoring system and maximum number of players supported at the same time. More specifically, the table tennis table of the present invention introduces (1) a unique line layout for the playing surface, (2) a novel method of scoring, (3) the ability to accommodate a third individual on each side enabling six individuals to play at the same time and (4) the ability to accommodate a third team of two people thus permitting either two teams of three or three teams of two people at the table playing at the same time.

The scoring system of the table tennis table game of the present invention requires accuracy skills on the part of the individual players or members of a team to strike an area that could advance the score by more than one point at the end of a rally. The table game is played on a playing surface resembling a hexagon with nets attached to a center net post of the table, terminating at the inside boundary of a four point rob shot area and dividing the total surface area into two or three areas, accommodating a maximum of six players.

The playing surface for each area have specific rules of play associated with them to test the skills of the players. The components associated with the playing surface areas comprise the service area which is divided into two parts, including the one point service area and the two point service area. The playing surface also comprises the three point rally area and the four point rob shot. The symmetrical layout of the playing surface allows for the placing of the nets to determine which areas are to serve as the three point rally and the four point rob shot.

The one point service area is the largest and is situated closest to the net, yielding one point to start a rally with the potential to become a two point, a three point or four point rally. The two point service area is directly behind the one point service area. A serve into this area begins a two point rally with the potential to become a three point or four point rally. The three point rally area is located adjacent to the two point service area and the four point rob shot is located at the endpoints of the net.

There is therefore provided in accordance with the invention, a table top for playing table tennis comprising a number N of table top sections adapted to be mated one to another so as to form a planar table top having three pairs of opposing edges thereby defining a substantially hexagonal playing surface, wherein the playing surface is divided into a plurality of service areas and rally areas and wherein N is a positive integer greater than or equal to one.

There is also provided in accordance with the invention, a table for playing table tennis comprising a planar table top having three pairs of opposing edges thereby defining a substantially hexagonal playing surface, the playing surface divided into a plurality of service areas and rally areas and foldable support means connected to the table top for supporting the table top in a substantially horizontal orientation.

There is further provided in accordance with the invention, a table for playing table tennis comprising two substantially symmetrical table top halves when joined form a planar table top having three pairs of opposing edges thereby defining a substantially hexagonal shaped playing surface, the table top halves adapted to be foldable between a horizontal playing position and a vertical closed storage position and foldable support means hingeably connected to the two table halves, the support means operative to support the table top in a substantially horizontal orientation.

There is also provided in accordance with the invention, a table for playing table tennis comprising two substantially symmetrical table top halves when joined form a planar table top having three pairs of opposing edges thereby defining a substantially hexagonal shaped playing surface, the table top halves adapted to be foldable between a horizontal playing position and a vertical closed storage position, collapsible support means connected to the table top comprising a table pivot assembly pivotably connected to the two table top halves, primary support means pivotably connected to the table pivot assembly, secondary support means pivotably connected to the table pivot assembly and wherein the two table top halves and the support means are movable between a play configuration adapted to support the table top in a substantially horizontal orientation and a storage configuration adapted to support the two table top halves in a vertical closed orientation.

There is further provided in accordance with the invention, a table for playing table tennis comprising six substantially similar table top wedges when assembled together form a planar table top having three pairs of opposing edges thereby defining a substantially hexagonal shaped playing surface and foldable support means hingeably connected to the six table wedges, the support means operative to support the table top in a substantially horizontal orientation.

There is also provided in accordance with the invention, a table for playing table tennis comprising six substantially similar table top wedges when assembled together form a planar table top having three pairs of opposing edges thereby defining a substantially hexagonal shaped playing surface, the six table top wedges adapted to be placed together to form the playing surface and to be removed for storage, collapsible support means connected to the table top comprising a table pivot assembly pivotably connected to the six table top wedges, primary support means pivotably connected to the table pivot assembly, secondary support means pivotably connected to table pivot assembly and wherein the six table top wedges and the support means are movable between a play configuration adapted to support the table top in a substantially horizontal orientation and a storage configuration adapted to support the six table top wedges in a storage orientation.

BRIEF DESCRIPTION OF THE DRAWINGS

The invention is herein described, by way of example only, with reference to the accompanying drawings, wherein.

DETAILED DESCRIPTION OF THE INVENTION

The present invention comprises a versatile multi-player table tennis table game apparatus and associated method of play. The table tennis game is played on a planar playing surface resembling a hexagon with nets that can be configured for 2-party or 3-party game play. The term Hexapong™ (an abbreviation for hexagonal ping pong) is used to refer to the table tennis table game associated method of play of the present invention. The playing surface of the hexapong table may be constructed of one or more substantially symmetrical portions. Two example embodiments are provided including 2-piece and 6-piece versions of the hexapong table. It is appreciated that one skilled in the art could construct the hexapong table of the present invention using any number of pieces, such as 1 piece, 2-pieces, 3-pieces, etc. using the principles described herein without departing from the scope of the invention. The construction of each of the two embodiments is different especially in their support means which are made up of different folding legs support mechanisms. Details of both are described infra beginning with the 2-piece hexapong table.

2-Piece Hexapong Table

Figure 1:
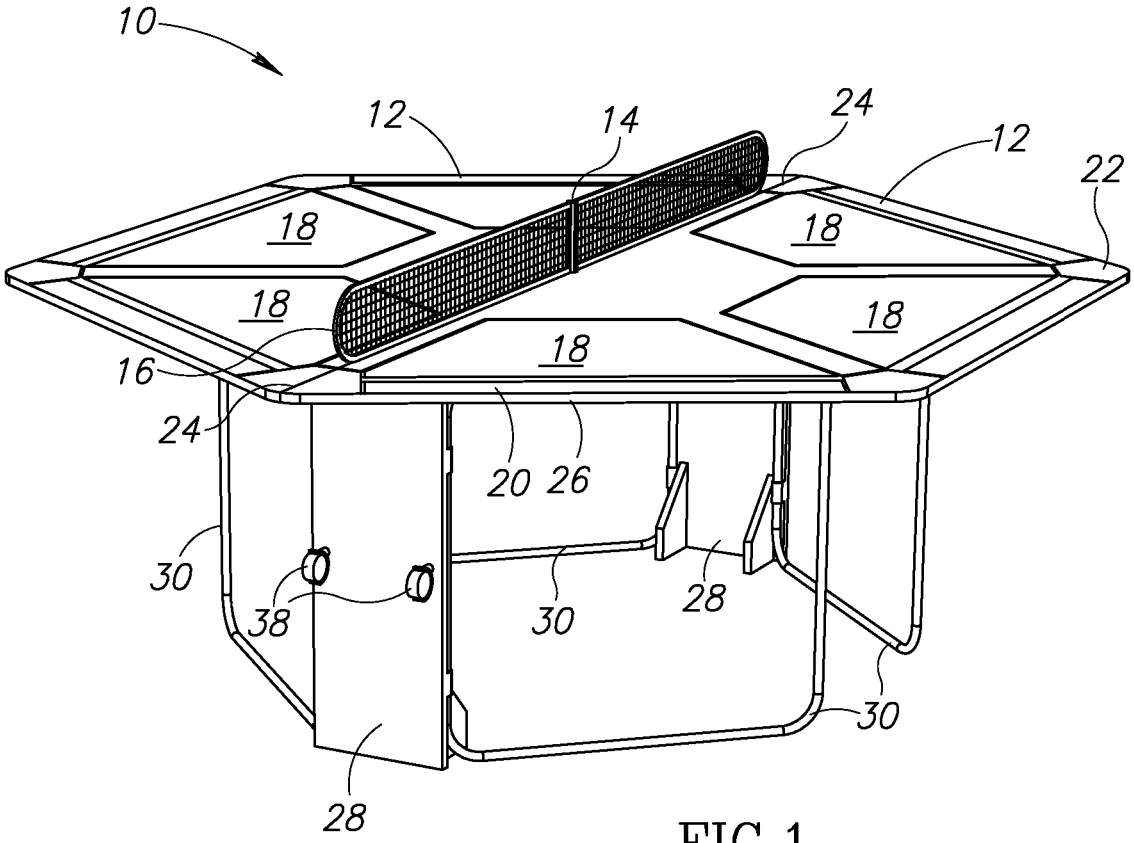
FIG. 1 is a perspective view of a fully open 2-piece foldable table tennis table of the present invention having a hexagonal shaped playing surface adapted for 2-party play.

A perspective view of a fully open 2-piece foldable table tennis table of the present invention having a hexagonal shaped playing surface adapted for 2-party play is shown in FIG. 1. The hexapong table (hereinafter referred to as the table), generally referenced 10, comprises two table top halves 12 that when joined together form a planar table top having three pairs of opposing edges which define a substantially hexagonal shaped playing surface. A center net post 14 supports a net 16 that divides the playing surface into two substantially equal playing areas. Each playing area comprises a plurality of service areas 18, 20 and rally areas 22, 24 which may have different point scores associated with them as described in more detail infra.

The folding support mechanism comprises a table brace (not shown), table pivot assembly (not shown), primary supports 28, secondary supports 30 and a plurality of casters 38. The folding support mechanism is movable from an open position which maintains the playing surface in a horizontal orientation to a closed position wherein the two table top halves fold up to a vertical storage position. The primary and secondary supports collapse and fold to place the table top in a compact storage configuration.

In the configuration illustrated in FIG. 1, the net 16 is operative to divide the playing surface into two equal playing areas. This configuration can accommodate two players with one on each side, four players with two on each side or six players with three on each side.

Figure 2:
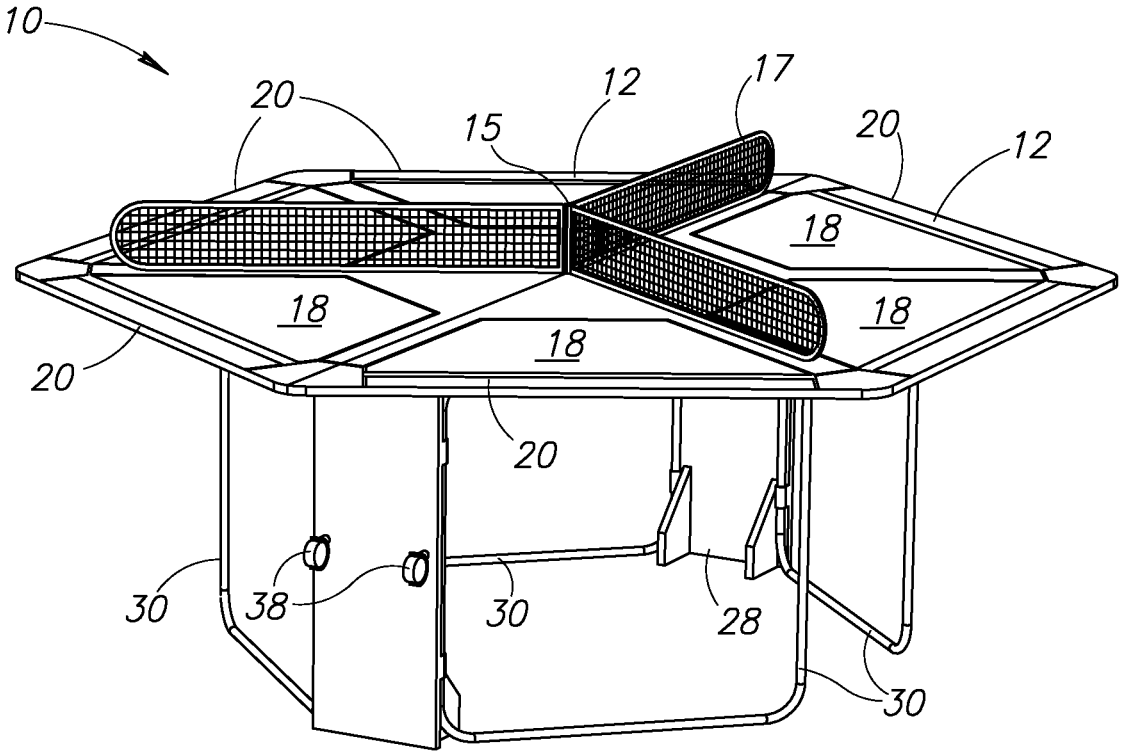
FIG. 2 is a perspective view of the fully open 2-piece foldable table tennis table of the present invention having a hexagonal shaped playing surface adapted for 3-party play.

A perspective view of the fully open 2-piece foldable table tennis table of the present invention having a hexagonal shaped playing surface adapted for 3-party play is shown in FIG. 2. The table tennis table, generally referenced 10, in this embodiment, comprises the same components and elements as the table tennis table of FIG. 1 except for the net 17 supported by the center net post 15. In this embodiment, the three section net is operative to divide the playing surface into three equal playing areas. This permits three individual to play at the same time or three teams of two individuals (for a total of six people) to play at the same time.

Figure 3:
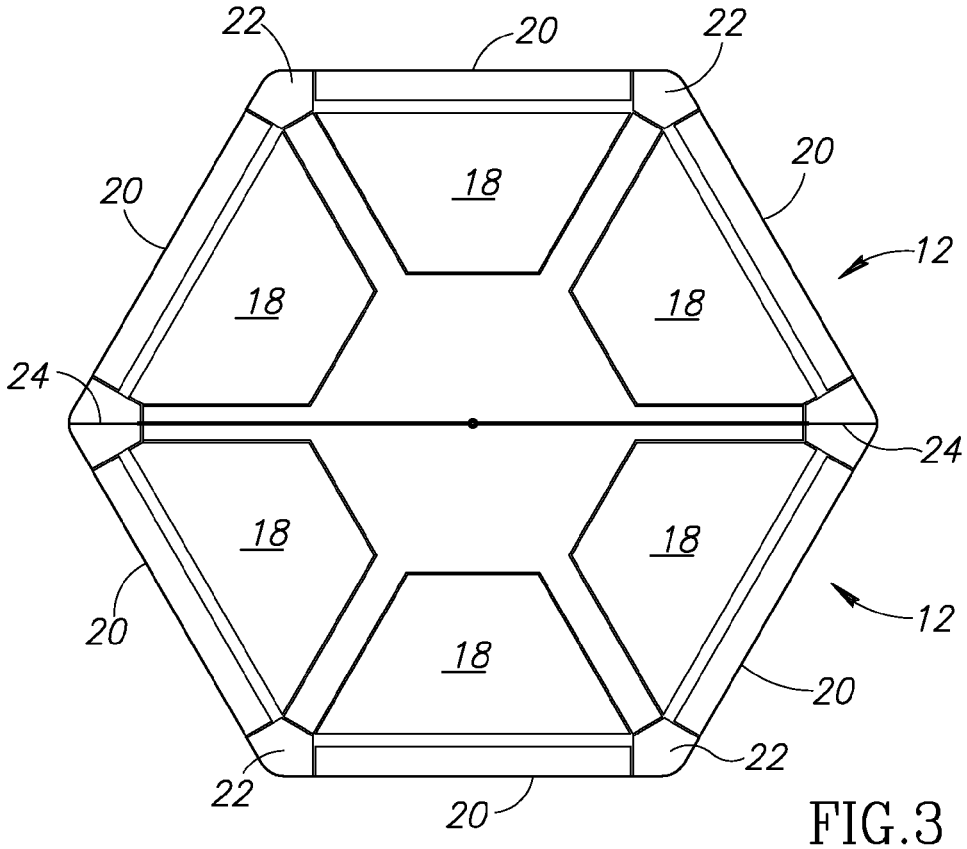
FIG. 3 is a top view of the hexagonal shaped playing surface of the 2-piece table tennis table of the present invention.

A top view of the hexagonal shaped playing surface of the 2-piece table tennis table of the present invention is shown in FIG. 3. The playing surface panel, generally referenced 12, is comprised of two substantially equal table top halves that when placed or joined together form a hexagonal shaped playing surface having three pairs of opposing edges. The playing areas on each table top half comprise three 1-point service areas 18, three 2-point service areas 20 and two 3-point rally areas 22. The rally areas 24 at either end of the net are referred to as 4-point rob shot rally areas. It is appreciated that both the service and rally areas may have different point scores associated with them than as described herein.

Figure 4:
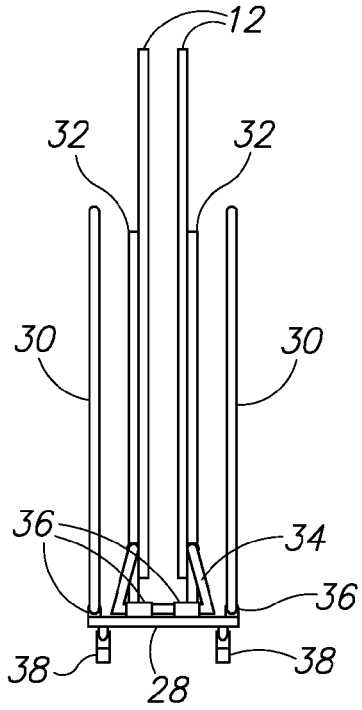
FIG. 4 is a side view of the hexagonal shaped playing surface of the 2-piece table tennis table of the present invention.

A side view of the hexagonal shaped playing surface of the 2-piece table tennis table of the present invention is shown in FIG. 4. This side view illustrates the table tennis table in the closed/folded storage position. The table top halves 12 are shown fastened to the table brace 32 which in turn is connected to the table pivot assembly 34. The table pivot assembly 34 is pivotably connected to the primary support 28 via hinges 36. The secondary supports 30 are also pivotably connected to the primary support 28 via hinges 36. Casters 38 attached to 28 permit the table to be easily wheeled from place to place.

Figure 5:
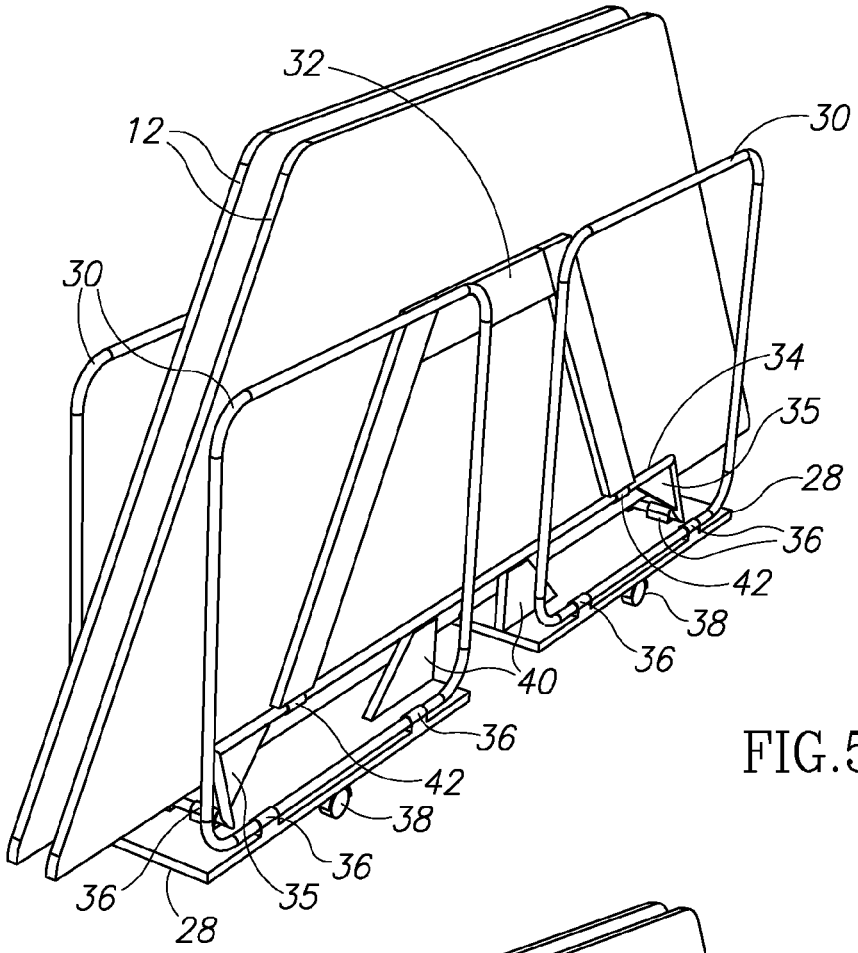
FIG. 5 is a perspective view of the hexagonal shaped playing surface of the 2-piece table tennis table of the present invention in the fully closed configuration.

A perspective view of the hexagonal shaped playing surface of the 2-piece table tennis table of the present invention in the fully closed configuration is shown in FIG. 5. The components of the foldable support mechanism are shown in this Figure which illustrates the table in the completely closed storage configuration The table top halves 12 are fastened to the table brace 32 using any suitable technique, e.g., nails, glue, screws, etc. The ends of the table brace 32 are pivotably connected to elongated table pivot assembly 34 via hinges 42. Gussets 35 functions to add rigidity and strength to the table pivot assembly. Note that alternatively, the gussets can be extended further toward the center of the table pivot assembly to add further strength. Depending on the material used for table top, the extended gussets may be needed for support. For example, the gussets on either side may be extend to approximately ⅓ of the distance of the length of the table pivot assembly. The extended gussets would have a cutout to permit the rotation of hinges 42.

The primary support legs 28 are have casters 38 mounted under them for mobility. The ends of the table pivot assembly are pivotably attached to the primary support legs via hinges 36. The rectangularly shaped secondary support legs 30 have rounded corners and are also pivotably attached to the primary support legs via hinges 36. Table pivot assembly blocks 40 are attached to one end of each of the primary support legs 28.

2-Piece Hexapong Table Storage

Figure 6:
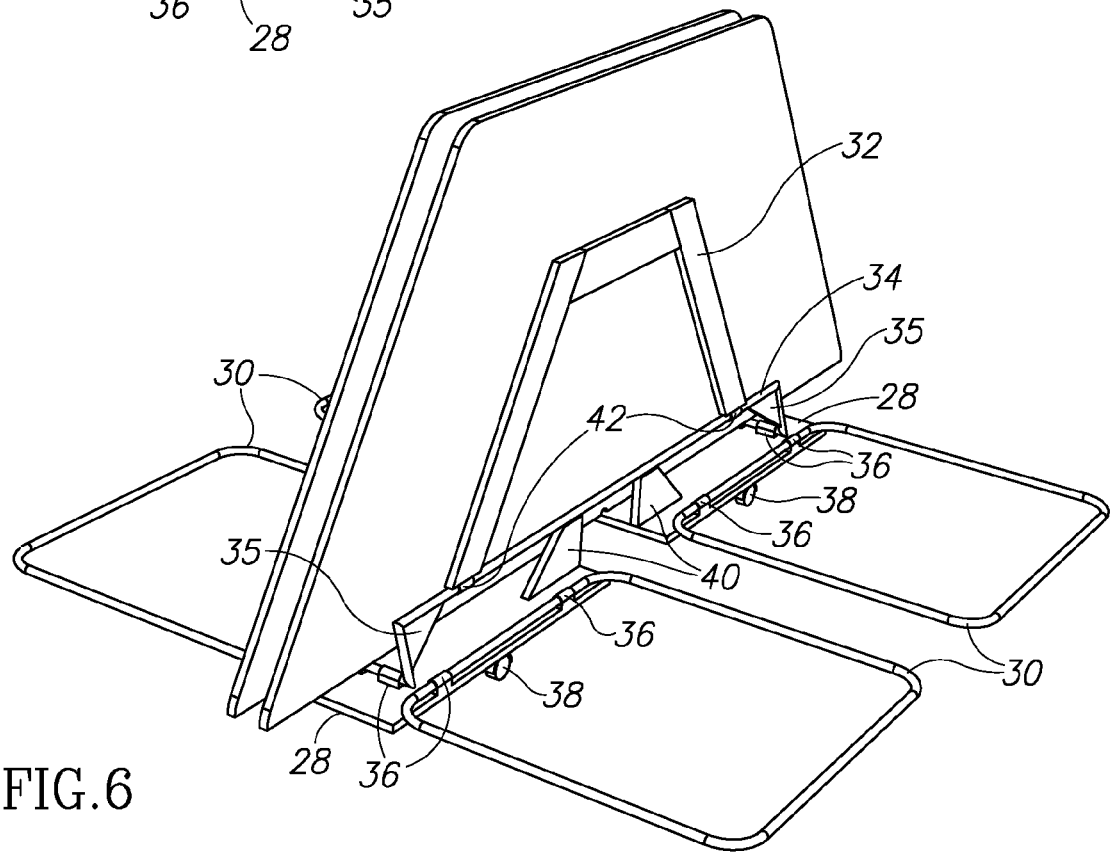
FIG. 6 is a perspective view of a first stage step of assembly of the hexagonal shaped 2-piece table tennis table of the present invention.

A perspective view of a first stage step of assembly of the hexagonal shaped 2-piece table tennis table of the present invention is shown in FIG. 6. In this first stage of opening the table, the secondary support legs 30 are lowered to the ground. Each of the four secondary support legs pivots on its hinges attaching it to the primary support legs 28.

Figure 7:
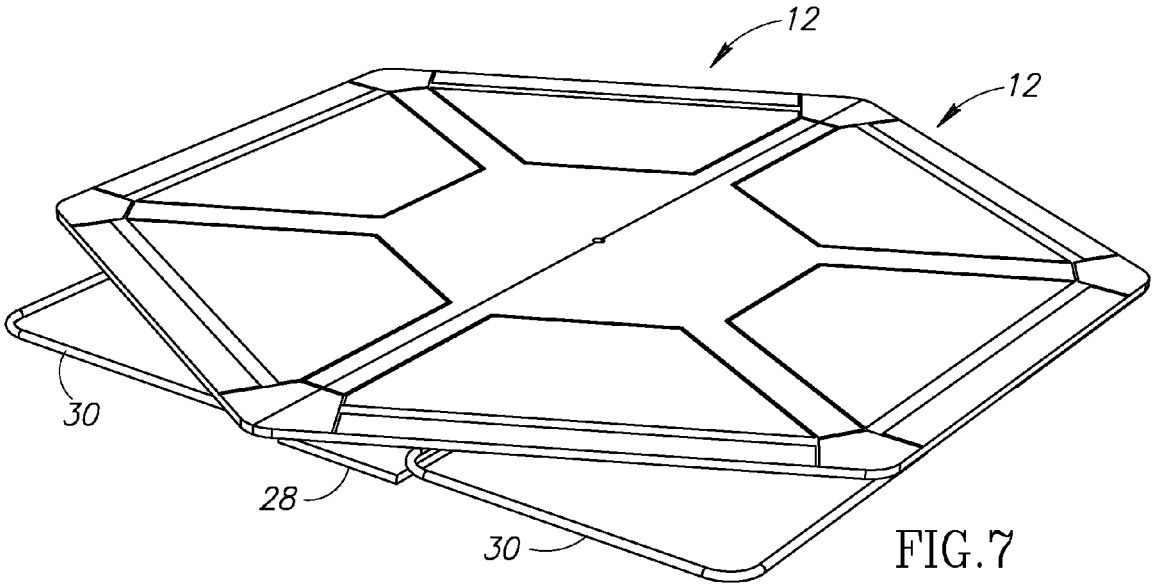
FIG. 7 is a perspective view of a second stage step of assembly of the hexagonal shaped 2-piece table tennis table of the present invention.

A perspective view of a second stage step of assembly of the hexagonal shaped 2-piece table tennis table of the present invention is shown in FIG. 7. In the second stage of opening the table, the two table top halves are lowered to the ground. With reference to FIG. 6, the table top halves 12 pivot around their hinged connections 42 to the table pivot assembly 34.

Figure 8:
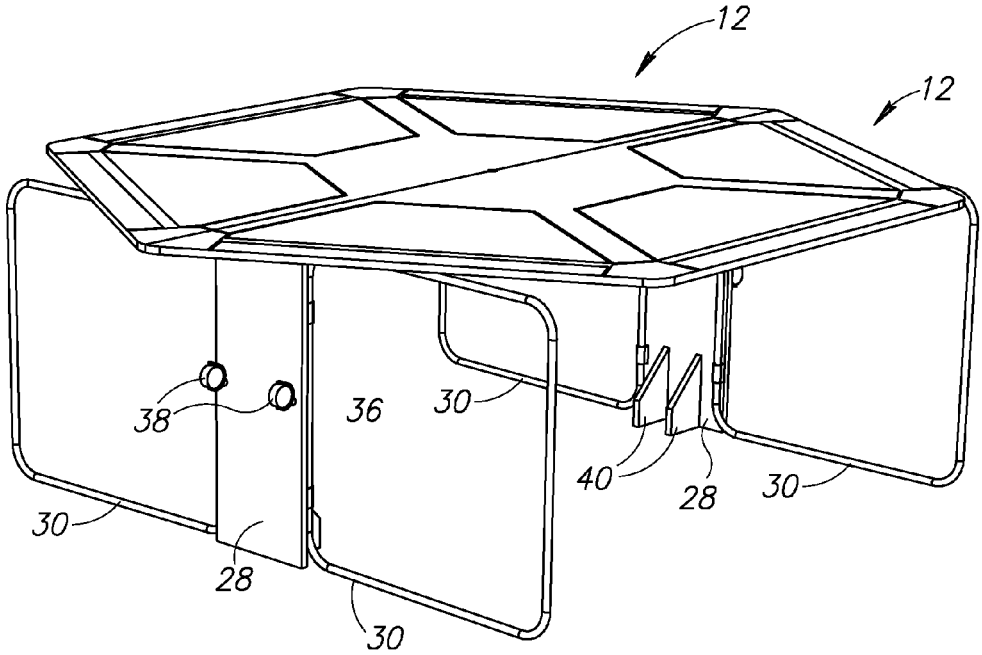
FIG. 8 is a perspective view of a third stage step of assembly of the hexagonal shaped 2-piece table tennis table of the present invention.

A perspective view of a third stage step of assembly of the hexagonal shaped 2-piece table tennis table of the present invention is shown in FIG. 8. In the third and final stage of opening the table, the table top halves are lifted sufficiently high to permit the primary support legs 28 to pivot downward due to gravity into a fully vertical orientation. While the table top halves remain lifted, the four secondary support legs 30 are swung inwardly towards the table and the table tops halves 12 are lowered to rest thereon. At this point, placing the center net post and net on the table yields the fully open and ready for play configuration shown in either FIG. 1 or FIG. 2 depending on the desired configuration of play.

With reference to FIGS. 1-2, 5-8, the procedure for storing the 2-piece folding hexapong table from a fully open position to a closed/storage position is provided hereinbelow. Note this procedure can be performed by one person but is easier if performed by two people.

1. First, the center net post 14/15 and nets 16/17 are removed.
2. The user then places themselves at one end of the folding edge of the table. The user reaches for the secondary support legs 30 and pivots them away from the table brace 32 attached to the underside of the playing surface until the two secondary support legs 30 and the primary support legs 28 form a straight plane.
3. Procedure 2 is repeated at the other table top half.
4. With the primary support legs 28 and secondary support legs 30 in a straight plane, the user pushes the bottom of the support assembly toward the center of the table allowing the table surface to descend to the floor.
5. The user returns to the other end and repeats Procedure 4.
6. With the primary support legs and secondary support legs now lying horizontally, the two playing surfaces are pulled upwards so as to pivot along the table pivot assembly 34 such that the two table top halves lean against each other.
7. The two secondary support legs are pivoted upwards to lay against the bottom of the playing surface and the legs are latched together with Velcro or some other fastening technique.
8. Return to the other end and repeat Procedure 6.

9. With the table folded and the distribution of weight on the table pivot assembly 34 and the table pivot assembly block 40 the casters 38 allow for rolling of the table to a desired storage location.

Figure 9:
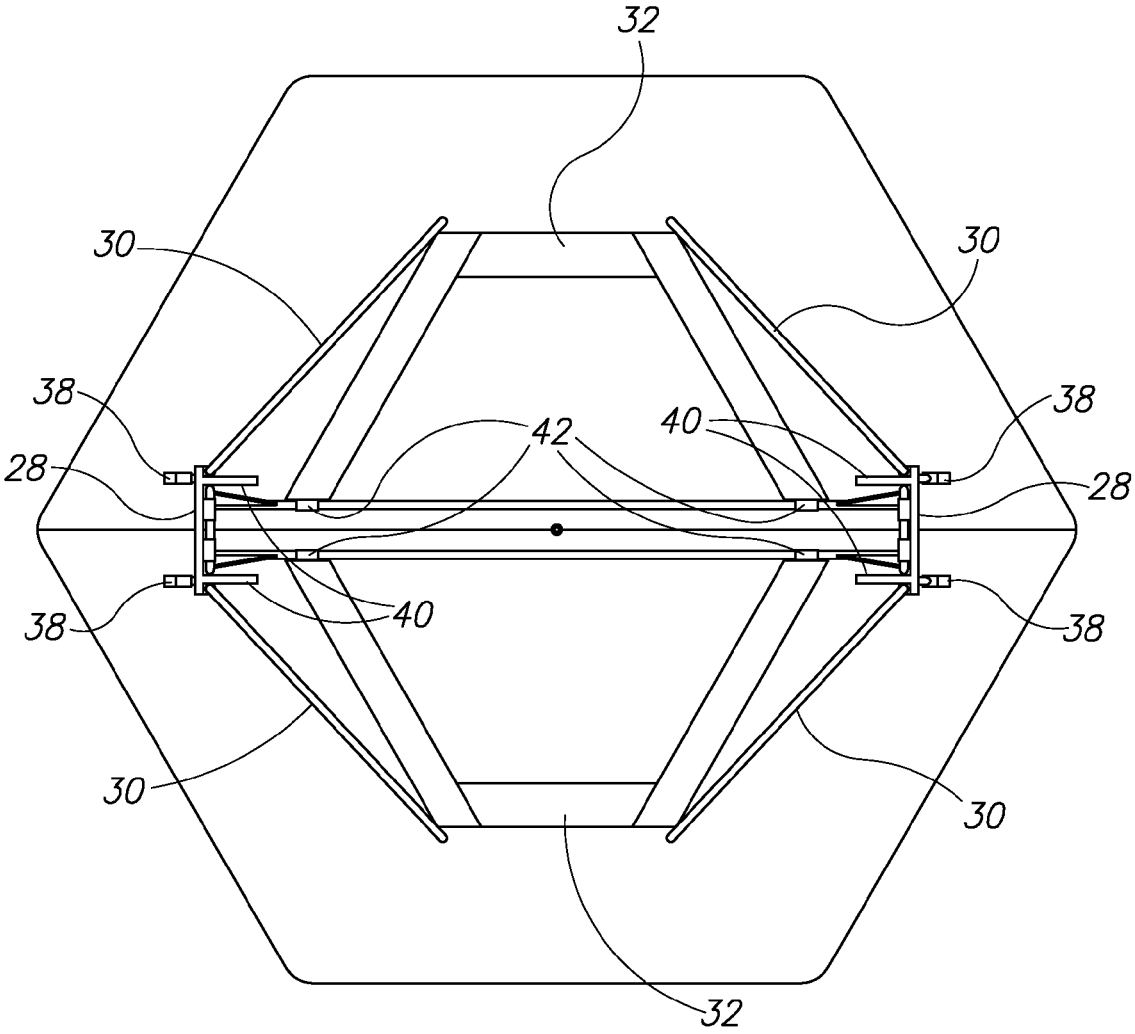
FIG. 9 is a bottom plan view of the hexagonal shaped 2-piece table tennis table of the present invention.

A bottom plan view of the hexagonal shaped 2-piece table tennis table of the present invention is shown in FIG. 9. This bottom up view shows the various components of the table in the fully open position. Note that the secondary support legs 30 are stopped by the edges of the table brace 32 thus positioning the secondary support legs in an optimal support position.

Figure 10:
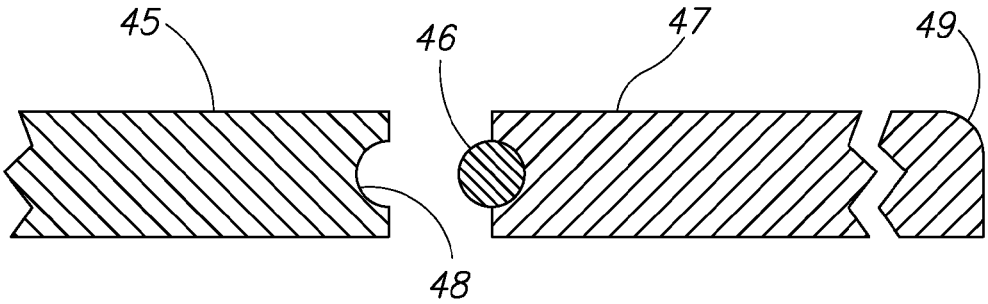
FIG. 10 is a side view of the registration mechanism for mating the two table top halves of the 2-piece and 6-piece table tennis table embodiments of the present invention.

A side view of the registration mechanism for mating the two table top halves of the 2-piece and 6-piece table tennis table embodiments of the present invention is shown in FIG. 10. In one embodiment of the invention, the registration of the table top sections 45, 47 (regardless of the number of sections) is improved by the provision of an alignment dowel 46 in each of the table top pieces. The alignment dowel in one piece fits into a depression 48 cutout of the adjoining piece. This aids in providing a uniformly smooth, flat and horizontal playing surface. Note that other well known alignment techniques may also be used without departing from the scope of the invention. Note also that in all embodiments, the table top portions optionally have edges with a rounded radius 49 to eliminate any sharp edges exposed to users during assembly, play and storage.

6-Piece Hexapong Table

Figure 11:
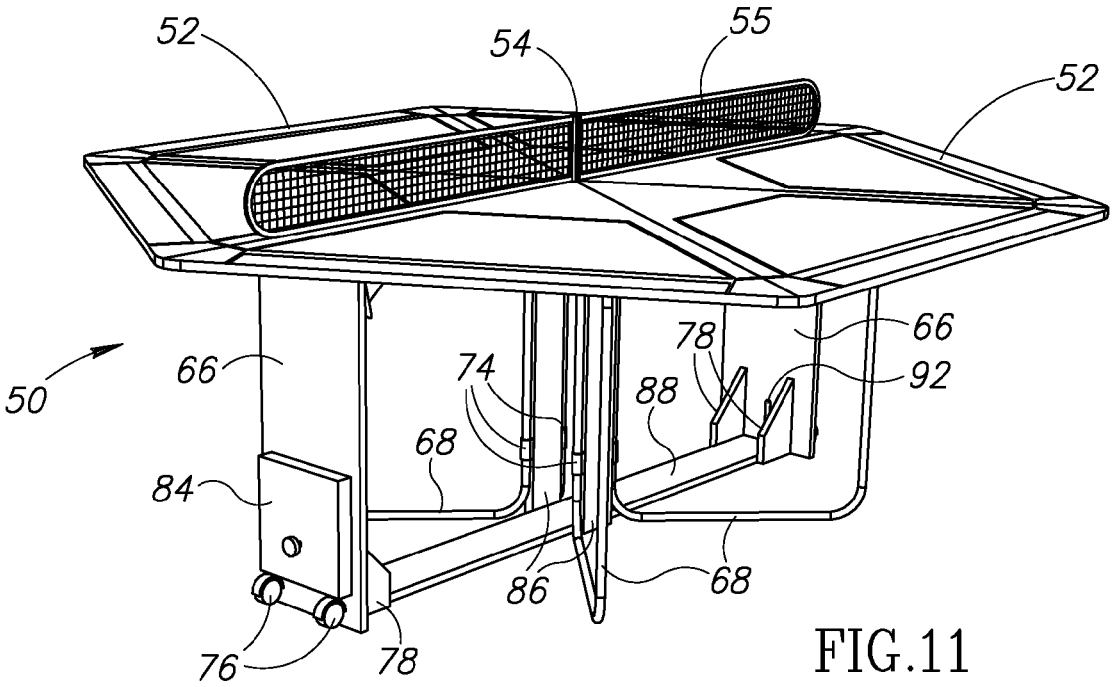
FIG. 11 is a perspective view of a fully open 6-piece foldable table tennis table of the present invention having a hexagonal shaped playing surface adapted for 2-party play.

A perspective view of a fully open 6-piece foldable table tennis table of the present invention having a hexagonal shaped playing surface adapted for 2-party play is shown in FIG. 11. The table tennis table (or hexapong table), generally referenced 50, is shown in a 2-party playing configuration. Note, however, that the table can easily be adapted for use in a 3-party playing configuration with the replacement of the center net post 54 and net 55 with a center net post and net suitable for 3-party play as shown in FIG. 2.

The table 50 comprises six table top wedges 52 that when joined together form a planar table top having three pairs of opposing edges which define a substantially hexagonal shaped playing surface. A center net post 54 supports a collapsible net 55 that divides the playing surface into two substantially equal playing areas. Each playing area comprises a plurality of service areas and rally areas which may have different point scores associated with them as described in more detail infra.

The folding support mechanism comprises a table brace (not shown), table pivot assembly (not shown), primary support legs 66, secondary support legs 68 caster adjustment assembly 84, bottom horizontal brace 88, table pivot assembly block 78, secondary support leg assembly 86 and a plurality of casters 76. The folding support mechanism is movable from an open position which maintains the playing surface in a horizontal orientation to a closed position wherein the six table top wedges are disassembled and stored in a vertical storage position. The primary and secondary support legs collapse and fold to place the table in a compact storage configuration.

In the configuration illustrated in FIG. 11, the net 55 is operative to divide the playing surface into two equal playing areas. This configuration can accommodate two players with one on each side, four players with two on each side or six players with three on each side. A three way net of the type shown in FIG. 2 permits 3-party play with three players on each of three sides or three teams of two players each for a total of six players.

Figure 12:
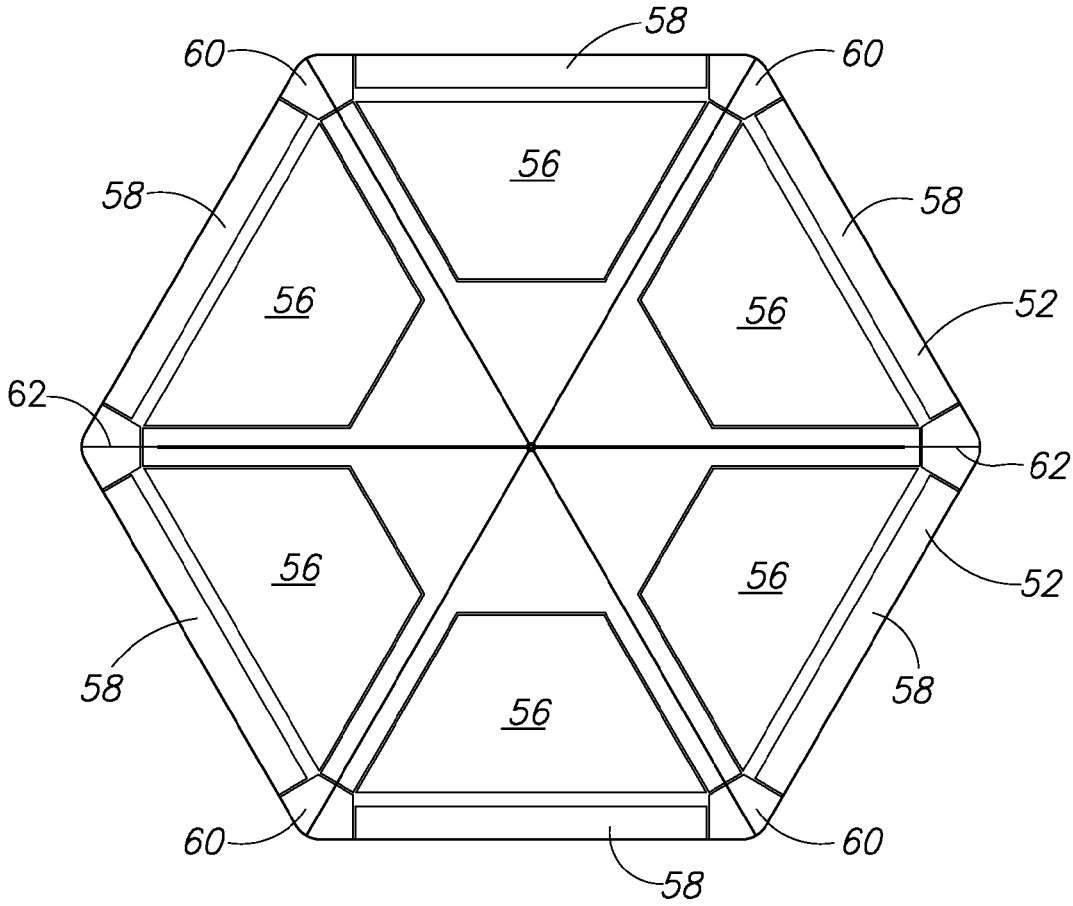
FIG. 12 is a top view of the hexagonal shaped playing surface of the 6-piece table tennis table of the present invention.

A top view of the hexagonal shaped playing surface of the 6-piece table tennis table of the present invention is shown in FIG. 12. The playing surface panel is comprised of six substantially equal table top wedges 52 that when placed or joined together form a hexagonal shaped playing surface having three pairs of opposing edges. The playing areas on each table top wedge comprise a 1-point service area 56 and a 2-point service area 58. When the six wedges are joined to form the playing surface, two rally areas are defined. Two 3-point rally areas 60 on each side are defined for 2-party play. The rally areas 62 at either end of the net (for 2-party play) are referred to as 4-point rob shot rally areas. It is appreciated that both the service and rally areas may have different point scores associated with them than as described herein.

Figure 13:
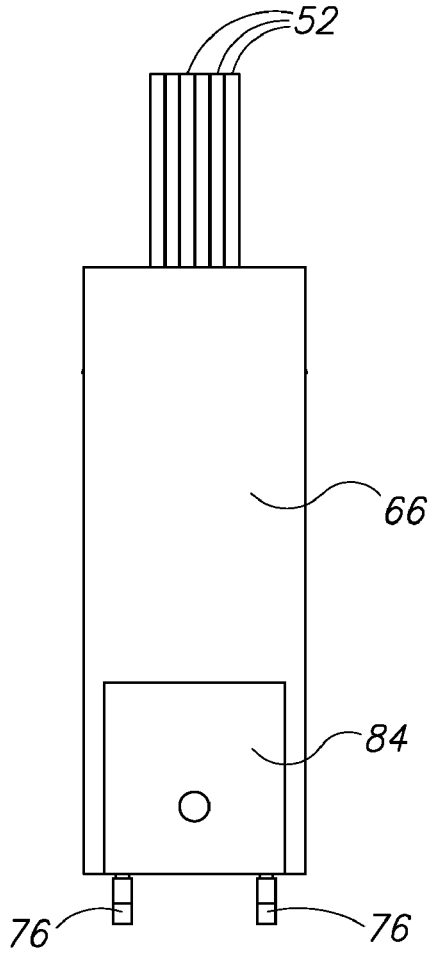
FIG. 13 is a side view of the hexagonal shaped playing surface of the 6-piece table tennis table of the present invention.

A side view of the hexagonal shaped playing surface of the 6-piece table tennis table of the present invention is shown in FIG. 13. This side view illustrates the 6-piece table tennis table in the closed/folded storage position. The six table top wedges 52 are shown stored in an upright vertical orientation. One of the primary support legs 66 is visible as well as the caster adjustment assembly 84 and casters 76.

Figure 14:
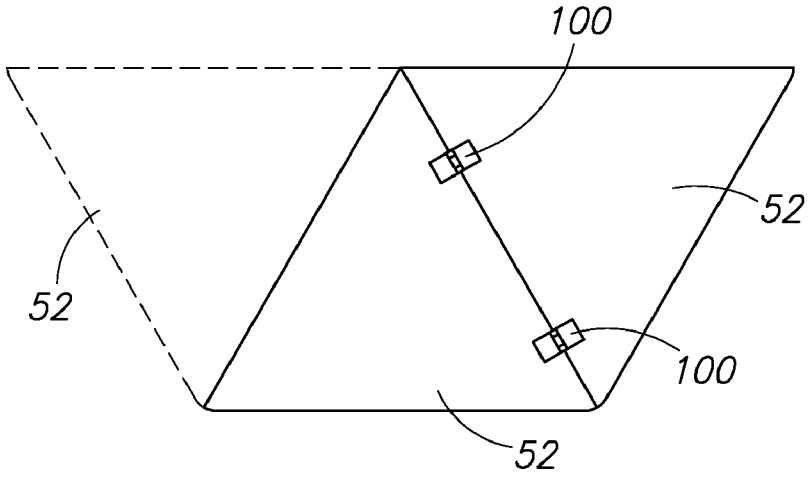
FIG. 14 is a diagram illustrating the optional hinge mechanism of the 6-piece hexagonal table tennis table of the present invention.

A diagram illustrating the optional hinge mechanism of the 6-piece hexagonal table tennis table of the present invention is shown in FIG. 14. To aid in assembling the playing surface from the six table top wedges, some or all of the table top wedges may be hingeably fastened to one another via one or more hinges 100. For example, each pair of table top wedges may be fastened by hinges to each other. This results in only three wedge assemblies that need to be joined to form the playing surface. To store the table top wedges, the three pairs are removed and folded and stored in the support assembly.

Figure 15:
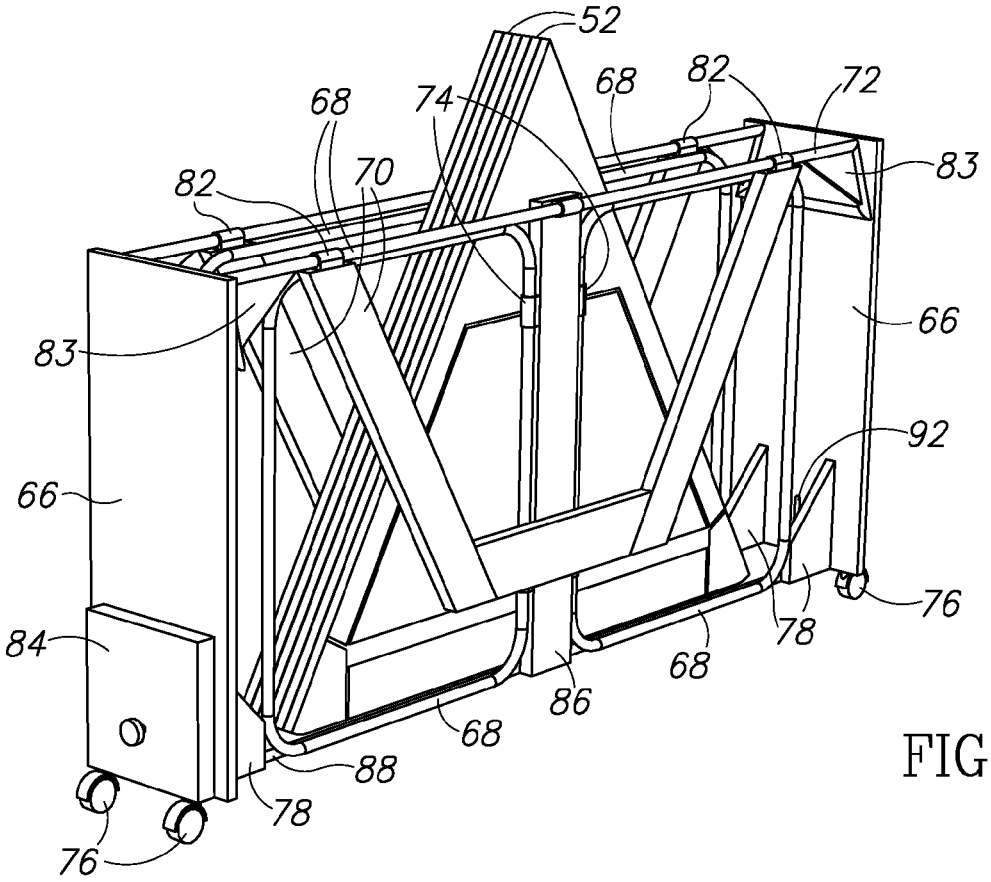
FIG. 15 is a perspective view of the hexagonal shaped playing surface of the 6-piece table tennis table of the present invention in the fully closed configuration.

A perspective view of the hexagonal shaped playing surface of the 6-piece table tennis table of the present invention in the fully closed configuration is shown in FIG. 15. The components of the foldable support mechanism are shown in this Figure which illustrates the 6-piece table in the completely closed storage configuration The six table top wedges 52 are not fastened to the table brace 70 as in the 2-piece embodiment described supra. The table top wedges are stored in the support mechanism and are adapted to rest on the bottom horizontal brace 88 that is connected to the primary support legs 66 using any suitable technique, e.g., nails, glue, screws, etc.

The ends of the table brace are pivotably connected to elongated table pivot assembly 72 via hinges or straight brackets 82. Gussets 83 function to add rigidity and strength to the table pivot assembly. The primary support legs 66 are attached to the ends of the table pivot assembly 72 and have casters 76 mounted under them to give the table mobility. The rectangularly shaped secondary support legs 68 have rounded corners and are pivotably attached to the center located secondary support leg assemblies 86 via hinges 74. Table pivot assembly blocks 78 are attached to one end of each of the primary support legs 66.

A slit opening 92 at the lower portion of each primary support leg permits the caster adjustment assembly 84 to be adjusted in the vertical direction. The caster adjustment assembly can be adjusted to lower the table so the bottom horizontal brace touches the floor in the play position and to raise the bottom horizontal brace off the floor for storage and mobility.

6-Piece Hexapong Table Storage

Figure 16:
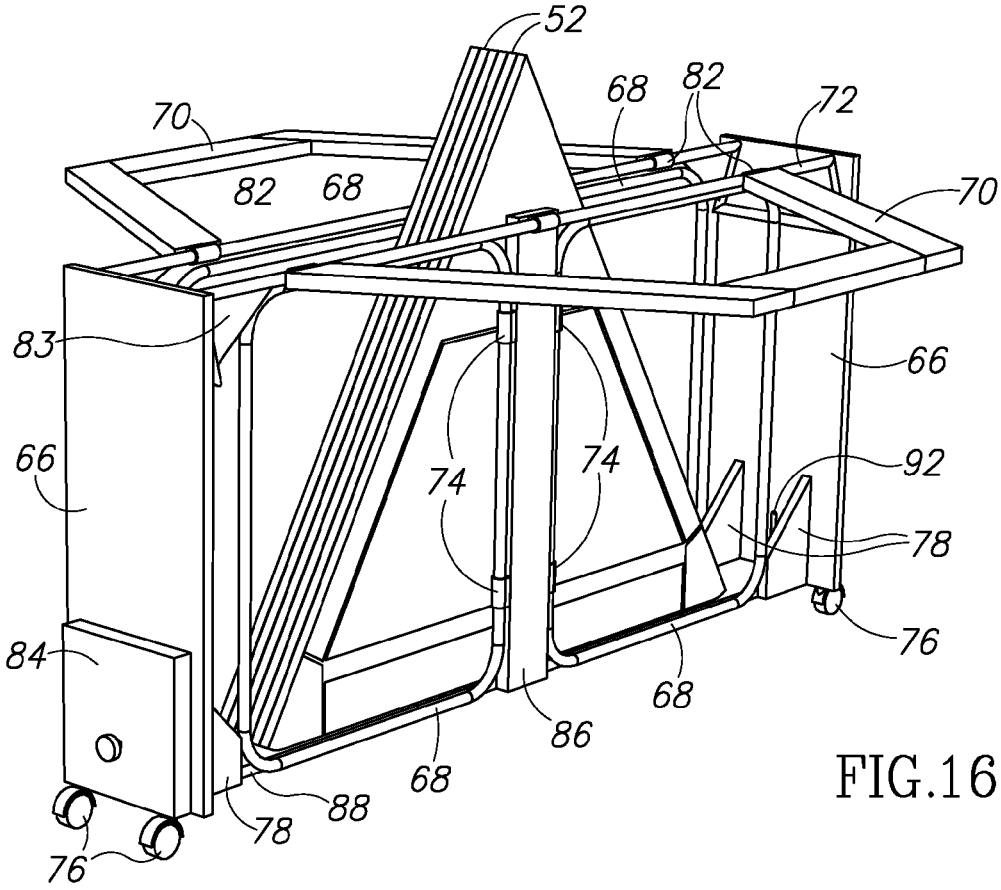
FIG. 16 is a perspective view of a first stage step of assembly of the hexagonal shaped 6-piece table tennis table of the present invention.

A perspective view of a first stage step of assembly of the hexagonal shaped 6-piece table tennis table of the present invention is shown in FIG. 16. In the first step of opening the 6-piece table tennis table, the table braces 70 are lifted. The table brace is hingeably connected to the table pivot assembly 72 via brackets or hinges 82. The table is still in the raised storage position being to roll on the casters from place to place.

Figure 17:
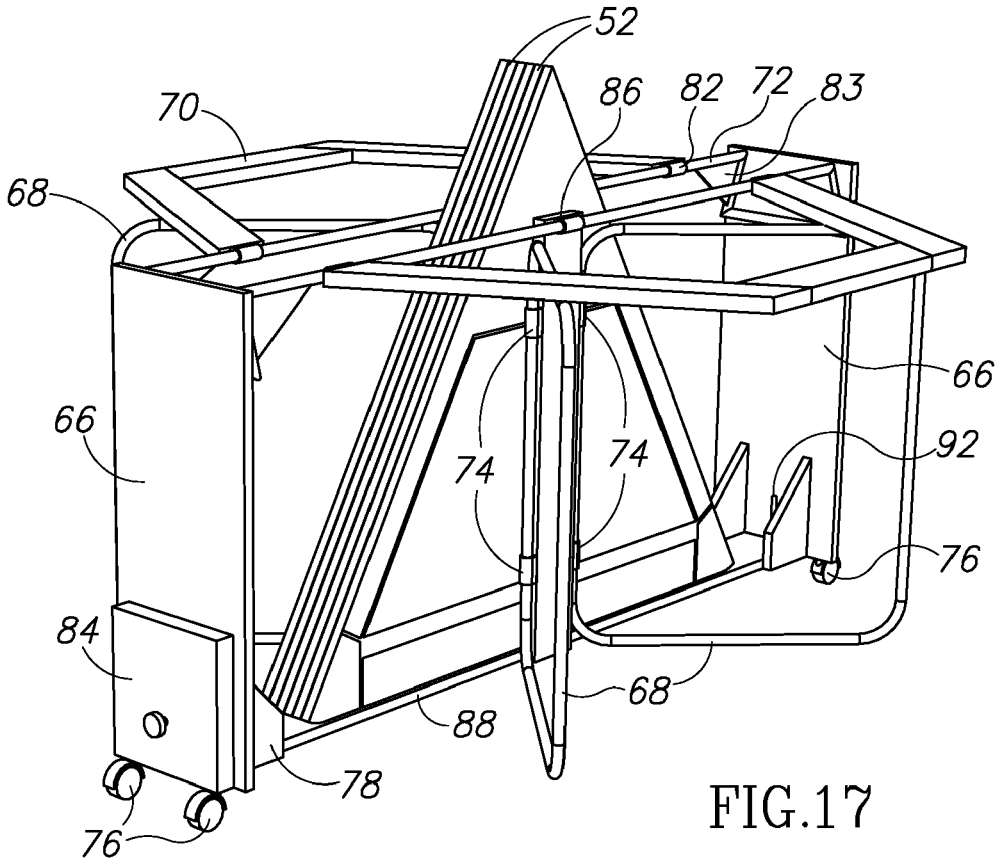
FIG. 17 is a perspective view of a second stage step of assembly of the hexagonal shaped 6-piece table tennis table of the present invention.

A perspective view of a second stage step of assembly of the hexagonal shaped 6-piece table tennis table of the present invention is shown in FIG. 17. In this next stage, the secondary support legs 68 are swung outwards to lie under the table braces 70 to form an approximate 45 degree angle with the stored table top wedges. The secondary support legs 68 are attached to stationary secondary support leg assemblies 86 via a plurality of hinges/brackets 74. The secondary support leg assemblies 86 are attached to the table pivot assembly 72 at the top and to the bottom horizontal brace 88 at the bottom.

Once the secondary support legs are in position, the table top wedges are placed on top of the table brace 70 and joined to form the hexagonal shaped playing surface. The bolt or other fastener attaching the caster adjustment assemblies 84 to the primary support legs are loosened and the table lowered to rest on the ground. Once assembly of the table is complete, either the 2-party or 3-party net is then placed in position on the playing surface. The result is the table tennis table shown in FIG. 11 (for 2-party play).

With reference to FIGS. 11, 15-17, the procedure for storing the 6-piece folding hexapong table from a fully open position to a closed/storage position is provided hereinbelow. Note this procedure can be performed by one person but is easier if performed by two people.

1. First, the center net post 54 and net 55 are removed.
2. The user then releases a latch on the underside of the table top wedges (i.e. playing surface panels) and lays it aside.
3. Procedure 2 is then repeated for the other five playing table top wedges.
4. With all panels removed, the secondary support legs are swung inwards toward the table pivot assembly.
5. Procedure 4 is repeated for all other secondary support legs, thus permitting the table brace to rotate downward.
6. While lifting the table, the user then pushes the caster adjustment assembly down on both primary support legs to lock it in place thus raising the table off the ground and permit rolling on the casters.
7. All playing surface panels are placed within the table pivot assembly to rest on top of the bottom horizontal brace and between the secondary support leg assemblies.
8. With the table folded, the user rolls the table to a desired storage location.

Figure 18:
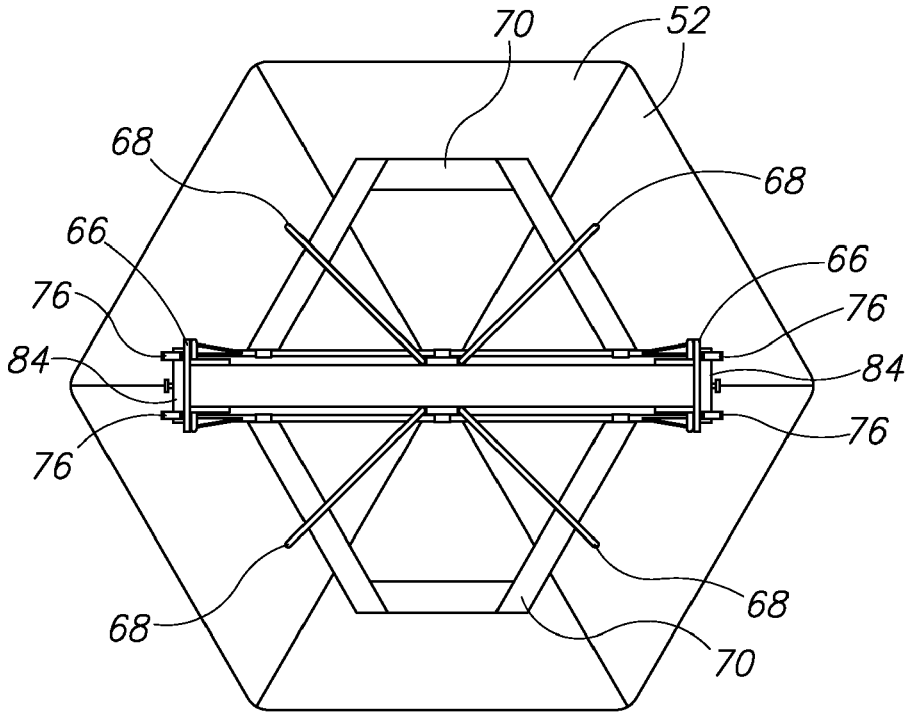
FIG. 18 is a bottom plan view of the hexagonal shaped 6-piece table tennis table of the present invention.

A bottom plan view of the hexagonal shaped 6-piece table tennis table of the present invention is shown in FIG. 18. This bottom up view shows the various components of the table in the fully open position. Note that the secondary support legs 68 can be placed anywhere under the table braces 70 but preferably should be placed about 45 degrees from the plane of the table pivot assembly. Optionally, stops may be placed on the underside of the table braces to aid in placing the secondary support legs in an optimum position when opening the table.

Note that the following applies to both the 2-piece and 6-piece table tennis table embodiments. The table top halves and wedges may comprise any suitable rigid or semi rigid material or combination of materials such as particle board, sheet metal, MDF board, fiber board, cementitious backer board, plywood, etc. The center net post may be constructed, for example, from molded solid or hollow plastic or fabricated wood stock. The collapsible net may be constructed, for example, from molded flexible plastic which is sufficiently rigid to withstand a maximum of four pounds of force before collapsing with a peg appendage at the bottom of the rounded end. The line layout of the playing surface comprises both thin and wide lines. Thin lines may comprise ¼ inch tape while wider lines may comprise 2 inch tape. Alternatively, all lines may be painted directly onto the playing surface.

The primary support legs may be constructed from stock lumbar, particle board, MDF board, fiber board, sheet metal, etc. or any combination thereof. The secondary support legs and the table pivot assembly may be constructed from ¾ inch metal tubing such as aluminum or lightweight steel. The table brace may comprise ¾ inch square tubing that is welded and shaped or stock wood lumbar that is cut and shaped.

The table pivot assembly block, secondary support leg assemblies and bottom horizontal brace may be constructed from any suitable rigid or semi rigid material or combination of materials such as particle board, sheet metal, MDF board, fiber board, cementitious backer board, plywood, etc.

Figure 19:
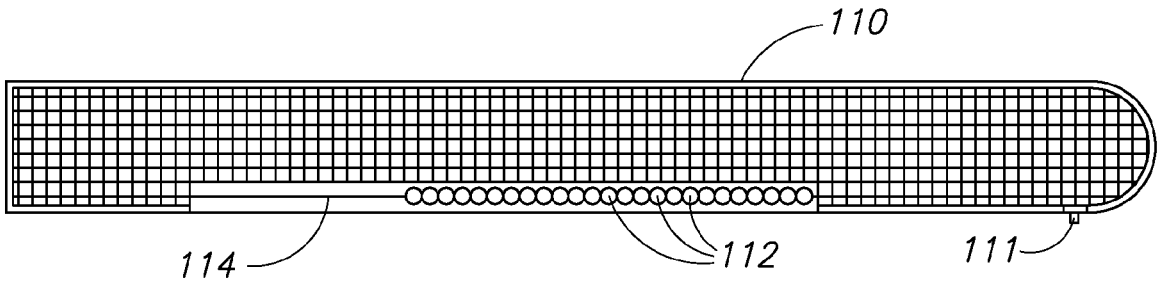
FIG. 19 is a diagram illustrating scoring beads incorporated into the net for use with the 2-piece and 6-piece hexagonal shaped table tennis table of the present invention.

A diagram illustrating scoring beads incorporated into the net for use with the 2-piece and 6-piece hexagonal shaped table tennis table of the present invention is shown in FIG. 19. To assist in keeping score, the invention comprises a net 110 incorporating a plurality of beads 112 that slide on a wire or rod. A peg 111 that mates with a corresponding hole in the table top helps keep the end of the net in proper position.

Figure 20:
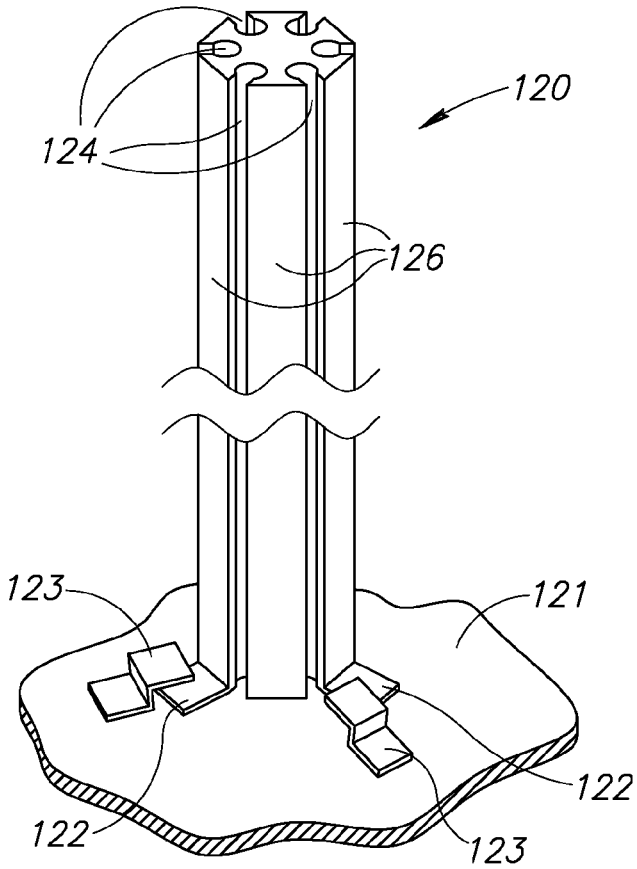
FIG. 20 is a diagram illustrating the center net post of the table tennis table of the present invention.

A diagram illustrating the center net post of the table tennis table of the present invention is shown in FIG. 20. The center net post, generally referenced 120, is adapted to be used in both 2-party and 3-party play configurations of the table tennis table. The net is attached to the center net post and terminates at the inside boundary of the four point rob shot area thereby dividing the playing surface area into two or three areas accommodating a maximum of six players. The post comprises latches 122 at its lower end for insertion in to corresponding catches 123 attached to or built into the center of the playing surface 121 of both 2-piece and 6-piece versions of the table. The border or frame portion of the net (not shown) is adapted to slide into the recessed slits 124 form by ridges 126 of the post. For 2-party play, two opposing slits are occupied by sections of the net while for 3-party play, three of the slits (each 120 degrees apart) are occupied by sections of the net.

Hexapong Rules of Play

The following description applies to both the 2-piece and 6-piece table tennis table embodiments. Reference is made to the 2-piece playing surface shown in FIG. 3 but applies equally to the 6-piece playing surface shown in FIG. 12. As described supra, the playing surface for each area have specific rules of play associated with them to test the skills of the players. The components associated with the playing surface areas include the service area, which is divided into two parts. With reference to FIG. 3, the first part is the 1-point service area 18 and the second part is the 2-point service area 20. The playing surface areas also comprise two rally parts. The first part is the 3-point rally area 22 and the second part is the 4-point rob shot area 24. The symmetrical layout of the playing surface allows for the placing of the net(s) to determine which areas are to be the 3-point rally or the 4-point rob shot areas.

The 1-point service area is the largest and closest to the net and yields one point to start a rally with the potential to become a 2-point, a 3-point or 4-point rally. The 2-point service area is located directly behind the 1-point service area and when the ball is served into this area, a 2-point rally is begun with the potential to become a 3-point or 4-point rally. The 3-point rally area is located adjacent to the 2-point service area and the 4-point rob shot are is located at the termination end of the nets.

During play, each team player serves twice before the opposing team gets to serve. Once it has been established which team serves first to start the game, the team member at the right side of the net will be the first to start.

When the ball is struck to begin a rally, this will be known as the serve. If the ball is served and hits the net falling into the service area 18, this will be known as a net serve and will be served again. A maximum of three net serves are allowed. If the ball is served and hits the net, but fails to land in the service area 18, this is referred to as a fault serve and the opposing team receives a point. Scoring is optionally kept with the aid of beads intergraded into the net for each team, as described supra.

The server may serve to the opposing team member parallel to his/her edge or to the opposing member in the adjacent position to the opposing team member parallel to his/her edge. The one point or two point serve may begin the rally and the highest point area hit before the end of the rally determines the points won for that rally.

Alternating serves after two serves and in a clockwise direction, the first team to win 25 points or winning by two points in case of tie score are the winners.

It is intended that the appended claims cover all such features and advantages of the invention that fall within the spirit and scope of the present invention. As numerous modifications and changes will readily occur to those skilled in the art, it is intended that the invention not be limited to the limited number of embodiments described herein. Accordingly, it will be appreciated that all suitable variations, modifications and equivalents may be resorted to, falling within the spirit and scope of the present invention.

What is claimed is:

1. A table top for playing table tennis, comprising:

a pair of table top sections adapted to be abutted together to form a planar table top having three pairs of opposing edges thereby defining a substantially hexagonal playing surface; and wherein said playing surface is divided into a plurality of service areas and rally areas.

2. A table for playing table tennis, comprising:

a pair of table top sections that when abutted together form a planar table top having three pairs of opposing edges thereby defining a substantially hexagonal playing surface, said playing surface divided into a plurality of service areas and rally areas; and foldable support means connected to each table top section for supporting said table top in a substantially horizontal orientation.

3. A table for playing table tennis, comprising:

two substantially symmetrical table top halves when joined form a planar table top having three pairs of opposing edges thereby defining a substantially hexagonal shaped playing surface, said table top halves adapted to be foldable between a horizontal playing position and a vertical closed storage position; and foldable support means hingeably connected to said two table halves, said support means operative to support said table top in a substantially horizontal orientation.

4. A table for playing table tennis, comprising:

two substantially symmetrical table top halves when joined form a planar table top having three pairs of opposing edges thereby defining a substantially hexagonal shaped playing surface, said table top halves adapted to be foldable between a horizontal playing position and a vertical closed storage position;

collapsible support means connected to said table top, comprising:

a table pivot assembly pivotably connected to said two table top halves;

primary support means pivotably connected to said table pivot assembly;

secondary support means pivotably connected to said table pivot assembly; and wherein said two table top halves and said support means are movable between a play configuration adapted to support said table top in a substantially horizontal orientation and a storage configuration adapted to support said two table top halves in a vertical closed orientation.

5. The table according to claims 1, 2, 3 or 4, further comprising a table tennis net connected perpendicularly to said playing surface, supported by a center net post and extending between two corners of said table top so as to divide said playing surface into two substantially equal playing areas.

6. The table according to claims 1, 2, 3 or 4, further comprising a table tennis net connected perpendicularly to said playing surface, supported by a center net post and extending between three corners of said table top so as to divide said playing surface into three substantially equal playing areas.

7. The table according to claims 1, 2, 3 or 4, wherein said playing surface is divided into two substantially equal sized areas adapted for 2-party play.

8. The table according to claims 1, 2, 3 or 4, wherein said playing surface is divided into three substantially equal sized areas adapted for 3-party play.

9. The table according to claims 1, 2, 3 or 4, wherein said playing surface comprises a plurality of first point service areas.

10. The table according to claims 1, 2, 3 or 4, wherein said playing surface comprises a plurality of second point service areas.

11. The table according to claims 1, 2, 3 or 4, wherein said playing surface comprises a plurality of third point rally areas.

12. The table according to claims 1, 2, 3 or 4, wherein said playing surface comprises a plurality of fourth point rally areas.

13. The table according to claims 2, 3 or 4, further comprising a plurality of casters mounted on said support means.

* * * * *